US007566825B2

(12) United States Patent
Ewell et al.

(10) Patent No.: US 7,566,825 B2
(45) Date of Patent: Jul. 28, 2009

(54) ADJUSTABLE HAND REST POST FOR MUSICAL INSTRUMENTS

(76) Inventors: Terry Barnard Ewell, 21 Stillway Garth, Cockeysville, MD (US) 21030; Richard Glenn Spencer, 503 Fairway Ct., Towson, MD (US) 21286

( * ) Notice: Subject to any disclaimer, the term of this patent is extended or adjusted under 35 U.S.C. 154(b) by 0 days.

(21) Appl. No.: 12/286,511

(22) Filed: Oct. 1, 2008

(65) Prior Publication Data

US 2009/0064845 A1 Mar. 12, 2009

(51) Int. Cl.
*G10D 7/10* (2006.01)
*G10D 7/00* (2006.01)

(52) U.S. Cl. ..... 84/387 A; 84/380 R; 84/380 A

(58) Field of Classification Search ..... 84/387 A
See application file for complete search history.

(56) References Cited

U.S. PATENT DOCUMENTS 3,988,958 A * 11/1976 Brunkow ..... 84/453
4,348,935 A * 9/1982 Bay ..... 84/380 R
2003/0164083 A1* 9/2003 Sundstrom ..... 84/387 A

* cited by examiner

*Primary Examiner*—Jeffrey Donels
*Assistant Examiner*—Christopher Uhlir

(57) ABSTRACT

Adjustable hand rest attachment for a musical instrument, wherein the hand rest post is constructed to provide multiple adjustments of the position of the hand rest on which the hand or hands of the musical performer rest when playing a musical instrument, such as a bassoon or contrabassoon. The adjustable hand rest attachment incorporates an articulated hand rest post to allow for varying angles of adjustment. The adjustable positioning of the hand rest achievable through adjustment of the articulated and adjustable hand rest post, reduces discomfort for the player and reduces injury with overuse. The adjustments of the hand rest and the hand rest post may then be secured into a fixed position. A bassoon is equipped with a key mechanism that is constructed using a tube that consists of a tenor joint, a boot (also known as a double) joint, a long joint, and a bell joint. A bassoon weighs approximately 8 pounds and is over 4 feet in length so that support of the instrument by the hands while playing without undue discomfort or fatigue is a significant concern. A contrabassoon is equipped with a key mechanism and is constructed using a tube of approximately double the length of the bassoon.

15 Claims, 12 Drawing Sheets

ADJUSTABLE HAND REST POST FOR MUSICAL INSTRUMENTS

BACKGROUND OF THE INVENTION

1. Field of Invention

The invention particularly relates to attaching an adjustable hand rest post to a musical instrument, such as a bassoon or contrabassoon, for positioning of the hand rest on which the left or right hand rest while performing on the instrument.

2. Prior Art

A bassoon (i.e., Fagott in German or fagotto in Italian) is a kind of woodwind instrument. The bassoon provides a key mechanism which operates to open or close sound holes which are arranged along a tube. A drawing of the front and back of a conventional bassoon is supplied in FIG. 1. (Also a drawing of a conventional bassoon is contained FIG. 3 in U.S. Pat. No. 5,892,167, of Apr. 6, 1999.)

A contrabassoon (i.e. Contrafagott in German) is a kind of woodwind instrument. The contrabassoon provides a key mechanism which operates to open or close sound holes that are arranged along a tube. A drawing of the front and back of a conventional contrabassoon is supplied in FIG. 2.

FIG. 3 shows the parts of a conventional hand rest and post. A hand rest (i.e., crutch) is a formed piece of wood, plastic, or synthetic polymers, affixed to a metal peg. A hand rest post 5A is a metal unit into which the hand rest peg 2 is placed and is then fixed into position with a thumb screw 3. The conventional hand rest and post together consist of: the hand rest 1, hand rest peg 2, thumb screw 3, a hand rest post 5A, a curved plate 12, and screw holes in the curved plate 11. Occasionally, a hand rest post includes a boss 4.

The hand rest post is attached to the bassoon on the boot (also known as the double) joint, that is, the lowermost joint, with four wood screws in the position shown in FIG. 4. This hand rest post is positioned for the player's right hand, between the E key and the A hole (finger 5 on FIG. 1).

The conventional example of the bassoon hand rest post has the problem that the hand rest, while exhibiting rotational mobility about the post axis, cannot be adjusted along the long (top-to-bottom) or short (side-to-side; lateral) dimensions of the bassoon. The conventional hand rest post is fixed in a position at an angle of 90 degrees from the body of the bassoon, thus requiring the right hand wrist of bassoon players to be flexed at an angle of nearly 90 degrees in order to use the conventional hand rest post. This positioning of the wrist causes discomfort and fatigue of the hand, and can result in injury with overuse. Further, the lack of adjustability of the conventional hand rest post limits the ability to balance the instrument in the playing position, leading to difficulties in maintaining the position of the instrument for long periods of time while playing. Further, the conventional example of the bassoon hand rest post has the problem that, due to its lack of adjustability, its position cannot be adapted for use with the left hand in the position shown in FIG. 9.

An adjustable hand rest apparatus, manufactured by Musik Spiri of Switzerland, is made of record. There are several disadvantages associated with this hand rest.

1. The Musik Spiri hand rest apparatus does not allow for the use of the player's existing hand rest, i.e., crutch. Experienced and professional players in particular become accustomed to the use of their own particular hand rest for optimal performance, so this is a significant limitation of the Musik Spiri device. In contrast, with the disclosed adjustable hand rest post, a player can use the hand rest to which he or she has become accustomed and practiced. This is because the adjustable portion of the disclosed device is a hand rest post, into which a conventional hand rest, such as the performer's preferred hand rest, is inserted in the conventional fashion.

2. The Musik Spiri apparatus, due to its design, has a limited range of lateral angle through which it can be adjusted. This substantially limits the ability of the performer to obtain an optimally comfortable playing position, and requires a greater amount of hand flexion for its use than is generally desirable. In contrast, the disclosed adjustable hand rest apparatus has a much greater range of lateral angle through with it can be adjusted and fixed than does the Musik Spiri apparatus. This permits the player to perform with whatever amount of hand flexion is desired, without any limitations.

3. The Musik Spiri apparatus is more complex in its manufacture, requiring more bearings, more adjustment screws, and a substantial modification of the hand rest (i.e. crutch) itself. The latter must be partially hollowed out in order to attach the Musik Spiri apparatus. In contrast, the instant adjustable hand rest post is simpler to manufacture, requiring only a single hinge joint in the preferred embodiment.

4. The complexity of the Musik Spiri device, and the fact that it consists of not only a modified hand rest post but also of a modified hand rest, leads to substantial cost. In contrast, the instant adjustable hand rest post is much simpler in design and manufacture, and permits use of the player's pre-existing hand rest, and is hence substantially less costly.

5. The adjustment of the Musik Spiri apparatus is complicated by its use of multiple attachment screws which must be loosened for adjustment, and then tightened for performance. In contrast, the instant hand rest post can be easily and quickly adjusted by a single screw. This adjustment is sufficiently rapid that it can be readily carried out during rest periods during a performance.

6. The Musik Spiri apparatus does not permit adjustment in height of the hand rest, because it is based on sliding ball-and-socket joints. Therefore, once the Musik Spiri device is constructed and installed onto the bassoon, there is no capacity to adjust the position of the player's hand closer or farther from the instrument. This is a significant limitation, as even the conventional hand rest apparatus permits such adjustment, which is regarded as crucial. In contrast to the Musik Spiri device, the instant hand rest assembly permits adjustment of the position of the player's hand closer or farther from the instrument, to the same degree as in the case of the conventional hand rest apparatus.

SUMMARY OF THE INVENTION

It is the object of the invention to provide multiple adjustments of the hand rest post into which a hand rest is inserted for the bassoon and contrabassoon. Below are samples of particular applications, but these applications do not limit the development of different solutions to adjustments in the hand rest post. The purpose of this invention is to improve comfort and lessen fatigue and strain of the hands and forearms of the bassoon performer. This is achieved by allowing the bassoon player to adjust the hand rest post to any angle with angulation about an axis parallel to the long axis of the bassoon or contrabassoon and incorporating a possible range of angulation of 0 to at least 90 degrees in either direction about said axis. As a result the amount of flexion in the wrist is reduced. This lesser and adjustable amount of flexion of the wrist and hand leads to less hand fatigue while playing the instrument for extended periods of time, thereby increasing performance facility and quality.

An additional purpose of the invention is to allow for better balance of the bassoon or contrabassoon, whether the performer is seated or standing, through optimal positioning of the hands, thereby modifying and reducing the forces exerted on the instrument to maintain it in the playing position, again reducing fatigue and strain on the performer's hands and arms.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Variable Angle Hand Rest Post (Ergopost)

When the desired angle of inclination is found in the variable angle hand rest post the hinging mechanism is locked into position by tightening the socket head cap screw. Alternatively a thumb screw or other screw may be utilized instead of the socket head cap screw.

Figure 5:
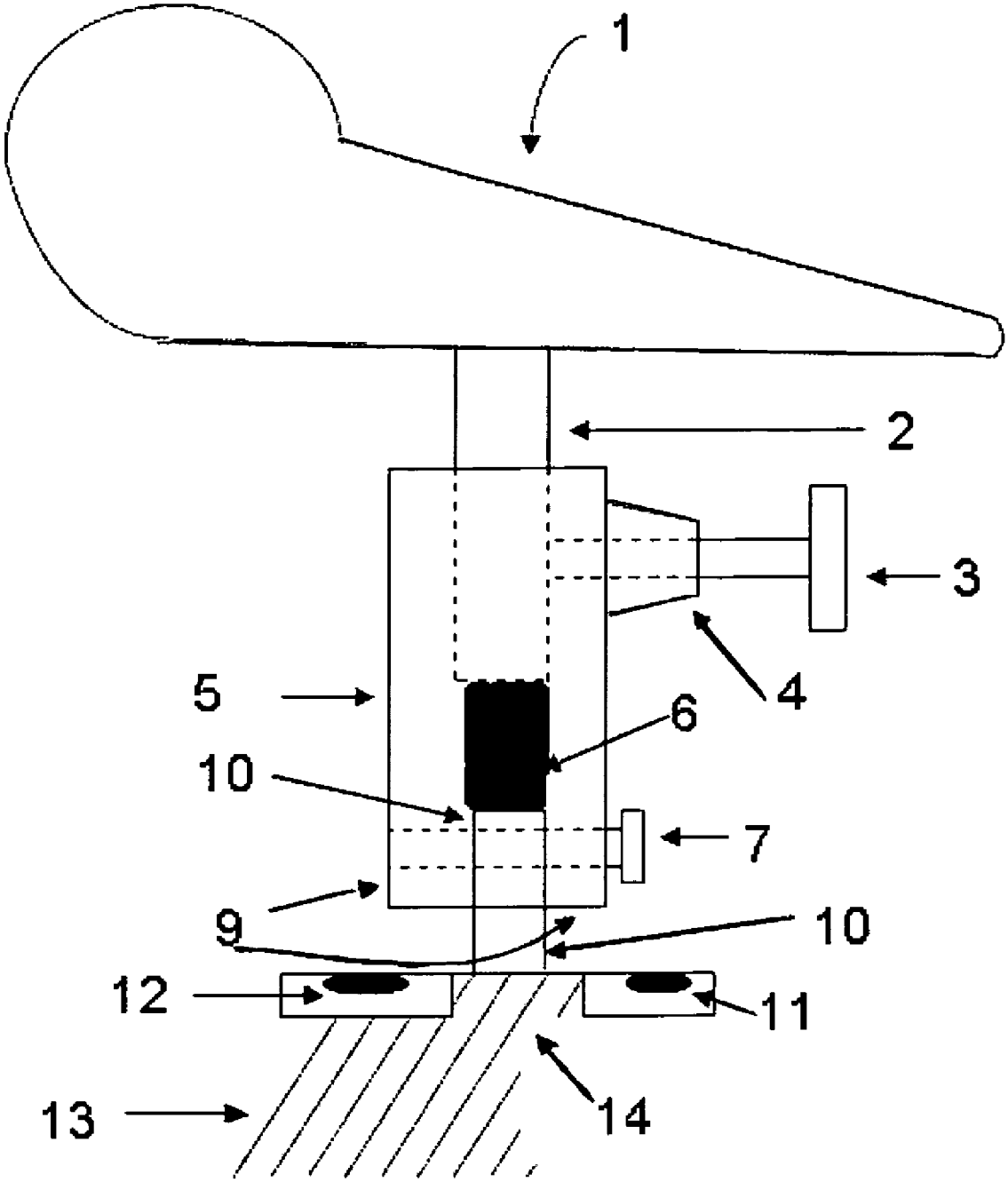
FIG. 5 is a plan view showing the invention with its component parts.

FIG. 5 details the present embodiment of the invention. As in the conventional hand rest post design, a base plate 12 (curved to a radius to conform to the body of the instrument) with screw holes 11 is attached by means of wood screws between the low E sound hole (covered by the E key) and the A sound hole of the boot joint, otherwise known as the double (lowermost) joint, of the instrument. (Please see FIG. 6 for another view of the base plate 12.)

The screws, bolts, etc. used for fastening the base plate to the body of the instrument may be modified by extending their depth or increasing their width in order to further stabilize the hand rest beyond what is required for the conventional static hand rest. The plate 12 may also be affixed to the instrument with an adhesive or bonding agent, screws, nails, clamps or by other means that are well known in the fastening art. The anchor post 10 is attached to the curved plate 12. The adjustable post unit 5 has a slot sufficiently wide to fit the anchor post 10; the anchor post 10 and adjustable post unit 5 are fastened together, for example, by means of a screw 7 through a hole in each.

The adjustable post 5 has threads on the thicker foot 9 at its base (at the side furthest from the head of the screw) for the socket head cap screw to be fastened into. The anchor post feet 9 have a rounded contour that allows for free lateral movement of the adjustable post unit (See FIGS. 7, 7A and 8). The adjustable post unit 5 is further split 6 above the joint with the anchor post to allow for the feet of the adjustable post to flex with the tightening of the bolt 7 so that the joint is secured when the desired angle is found.

The adjustable post unit 5 has two other holes in it, conforming to the conventional bassoon hand rest post. One threaded hole is directed inward from the side of the adjustable post unit on the side of the adjustable post unit (through the illustrated boss 4) and is for the entrance of a thumbscrew 3 to hold and tighten the peg 2 of the hand rest 1.

The second hole is not threaded and is oriented vertically outward along the long axis of the adjustable post unit. This hole is for the entrance of the pin 2 of the hand rest. It is this axis about which the conventional hand rest, as well as the variable angle bassoon hand rest post, has rotational mobility.

Figure 6:
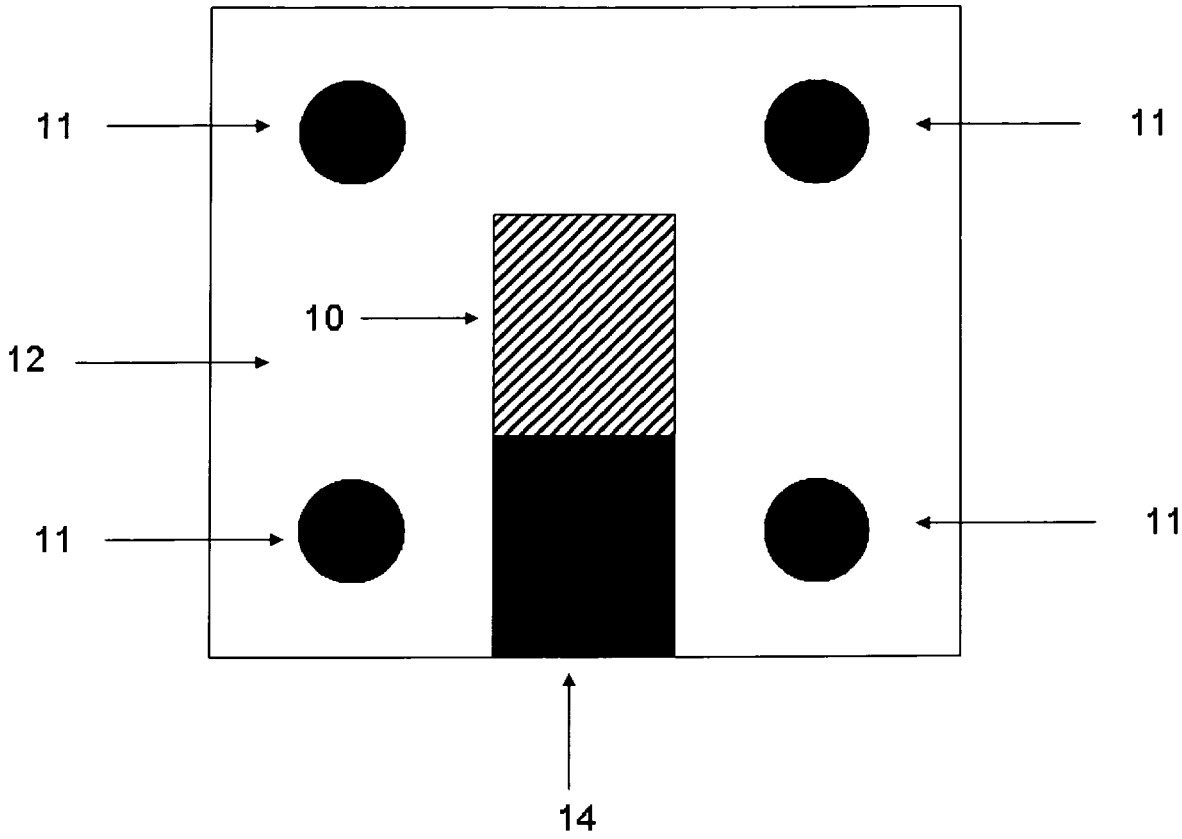
FIG. 6 is a plan view of the curved base plate and its component as viewed from above.

FIG. 6 gives a top down view of the curved base plate 12 with the anchor post 10 and the four screw holes 11. Additional screw holes may be added to stabilize the base plate 12 or the plate may be fixed to the bassoon with an adhesive or bonding agent. The base plate 12 may be modified to fit the standard hole placement of different makes of instruments, such as bassoons or contrabassoons. Please notice that segment 14 of the plate is cut out in order to allow for the free motion of the key work for the E key, that is, the key that covers the low E hole on the boot joint of the bassoon.

Figure 7:
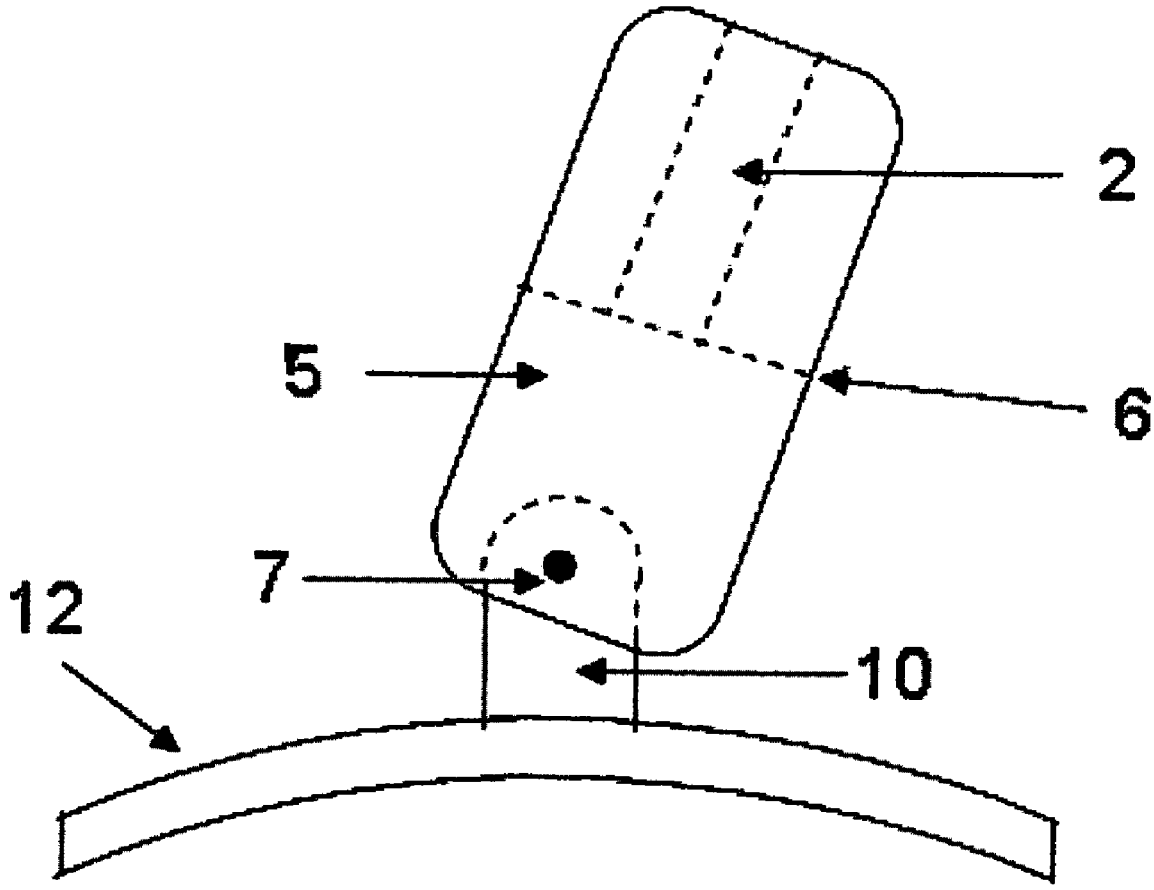
FIG. 7 is a plan view of the invention shown at an angle.
Figure 7A:
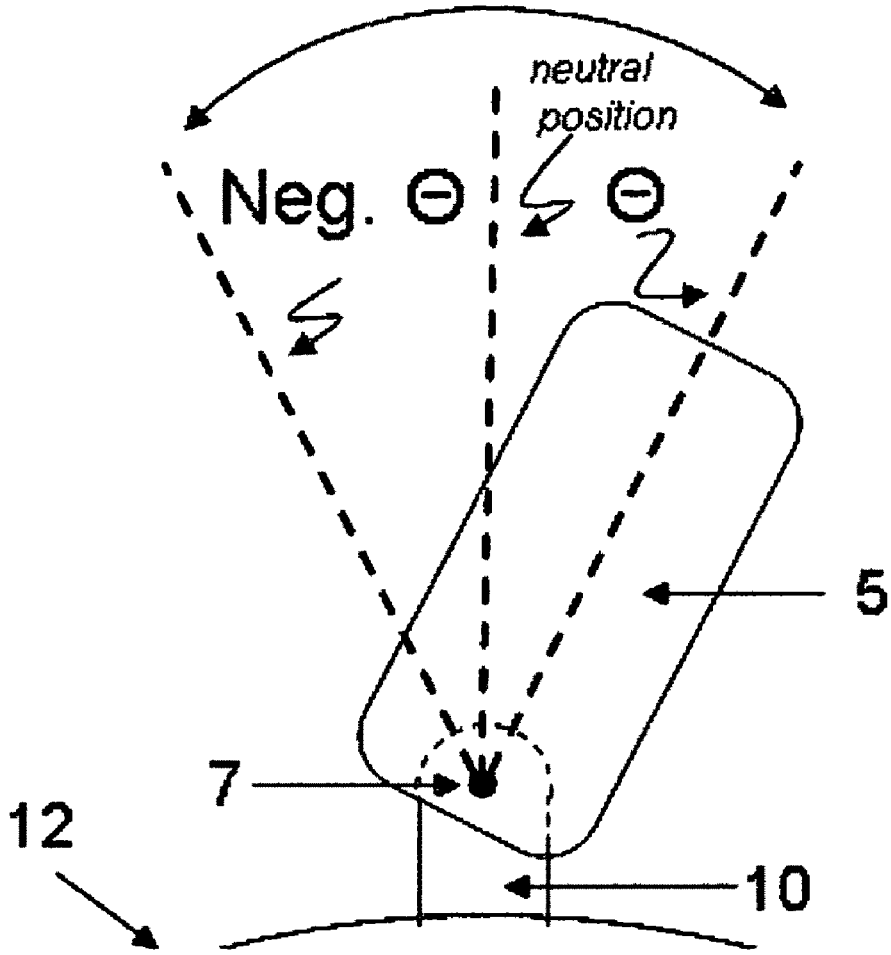
FIG. 7A is a plan view of the invention showing the angle of rotation θ, (theta).
Figure 8:
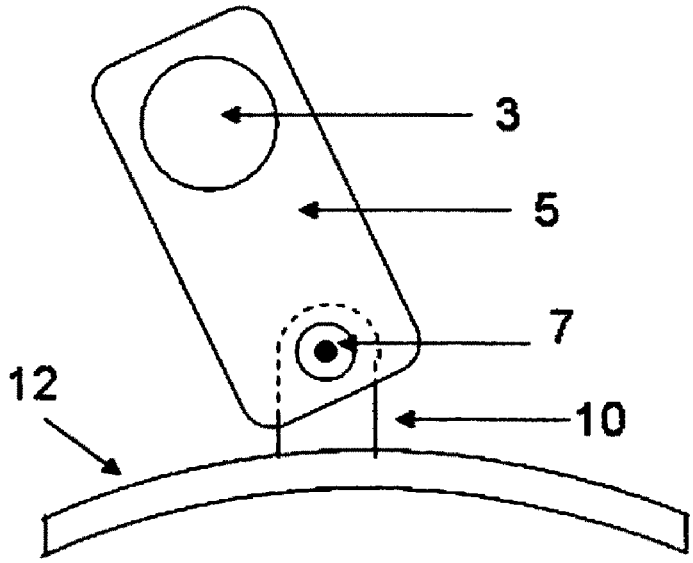
FIG. 8 is a plan view of the invention shown at an angle with placement of the thumbscrew.
Figure 9:
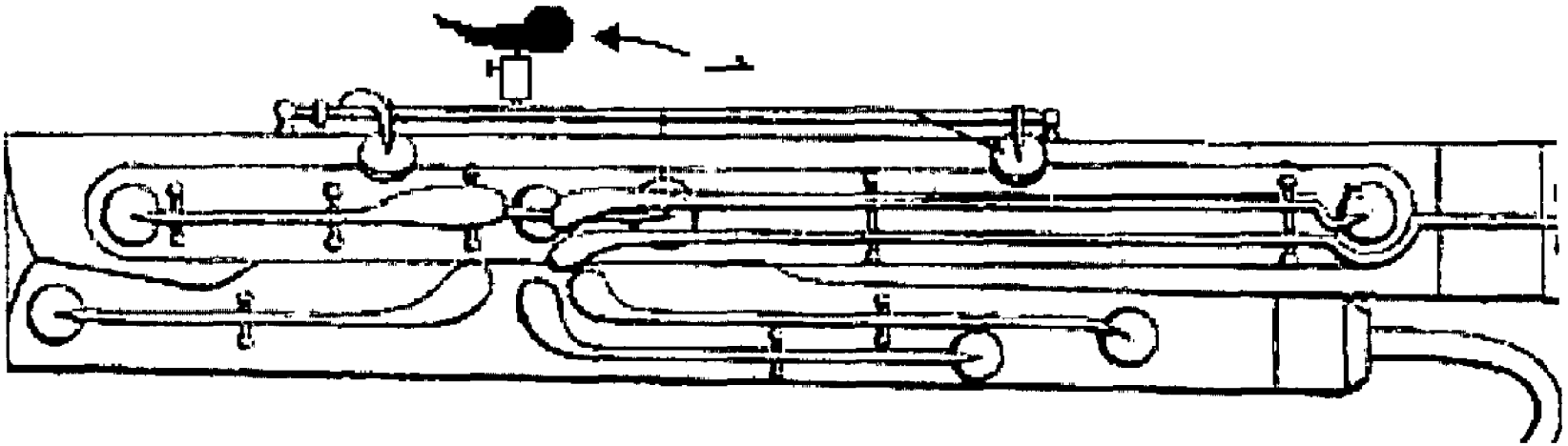
FIG. 9 is a plan view of the invention placed on the long joint of a bassoon for use of the player's left hand.

FIGS. 7, 7A and 8 show the adjustable post 5 tilting at an angle to the bassoon body. This angulation of post 5 is about an axis parallel to the long axis of the bassoon or contrabassoon and incorporating a possible range of angulation of 0 to at least 90 degrees in either direction about said axis. The player determines the angle that will lessen the amount of flexion of the wrist. This optimal position can then be fixed by securing the adjustable post 5 by means of tightening bolt 7. (The head of bolt 7 is shown in FIG. 8.) Thus, adjustments can achieve an angle ranging from 0 degrees to 90 degrees in either direction (+ or −), which can be designated as −90 to +90 degrees from the vertical axis that is perpendicular to the base plate 12. This lateral angular range is limited only by hindrance from the existing key work of the bassoon at the extreme angles, and not by the variable angle hand rest post device itself.

Other Embodiments of the Invention

Single Ball-and-Socket Joint with Variable Angle Upper Post.

This modification of the invention utilizes a single ball-and-socket joint with a variable angle upper joint to permit adjustment of the hand rest along both the long (top-to-bottom) and short (side-to-side; lateral) dimensions of the bassoon as well as rotation of the entire mechanism.

Figure 10:
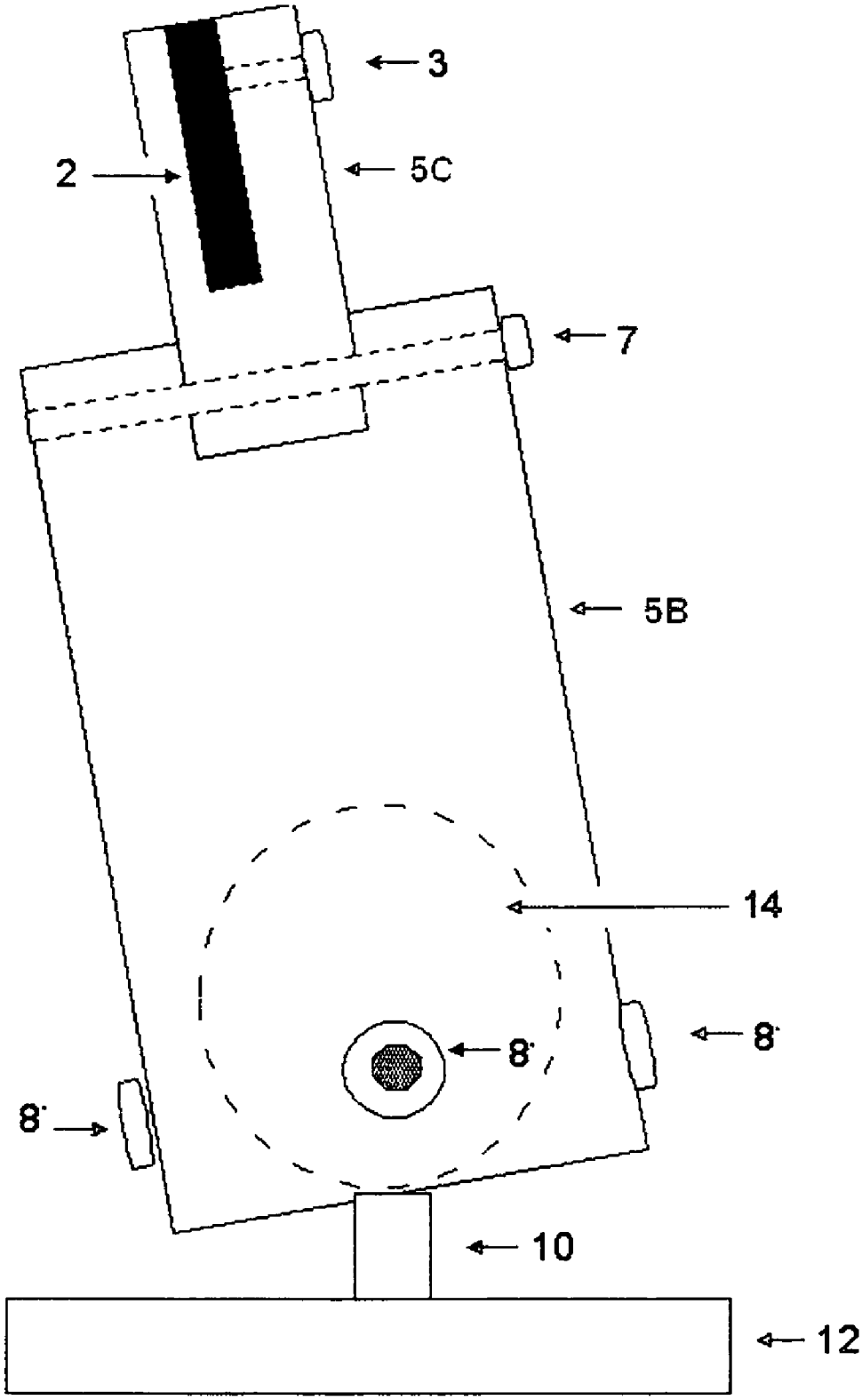
FIG. 10 is a plan view of the invention modified with a single ball-and-socket joint with variable angle upper post.

FIG. 10 details the hand rest and posts with the modifications. The curved base plate 12 attaches to the body of the bassoon by means of wood screws or adhesive or by other means. The ball 14 and socket design at the bottom of the fixed and moveable posts allow for mobility at many angles and rotations. The ball 14 attached to the fixed post is locked into position in the socket of the moveable post 5B by means of four socket head cap screws 8. The base of the moveable post 5B is hollowed out to allow for free motion of the ball 14. Other means of securing the ball and socket may be used as well. An alternative design could have the fixed post with the socket and the moveable post with the ball.

The moveable post 5B has a slot sufficiently wide to fit the variable angle upper post. This upper post and the moveable post unit are fastened together by means of a socket head cap screw 7 through a hole in each. The adjustable post has threads on the side furthest from the head of the screw for the socket head cap screw to be fastened into. Alternatively a thumbscrew or other screw may be utilized instead of the socket head cap screw. The upper post has a rounded contour that allows for free lateral movement within the moveable post unit (similar to FIG. 5).

The moveable post unit 5B may be further split below the joint to allow for the unit to flex with the tightening of the hex bolt so the joint is secured when the desired angle is found. The upper post unit 5C has two other holes in it conforming to the conventional bassoon hand rest post. One threaded hole is directed inward from the side of the adjustable post unit on the side of the adjustable post unit and is for the entrance of a thumbscrew to hold and tighten the pin of the hand rest. The second hole is not threaded and is oriented vertically outward along the long axis of the upper post unit. This hole is for the entrance of the pin of the hand rest. It is this axis about which the conventional hand rest, as well as the variable angle bassoon hand rest post (ErgoPost), has rotational mobility.

Figure 3:
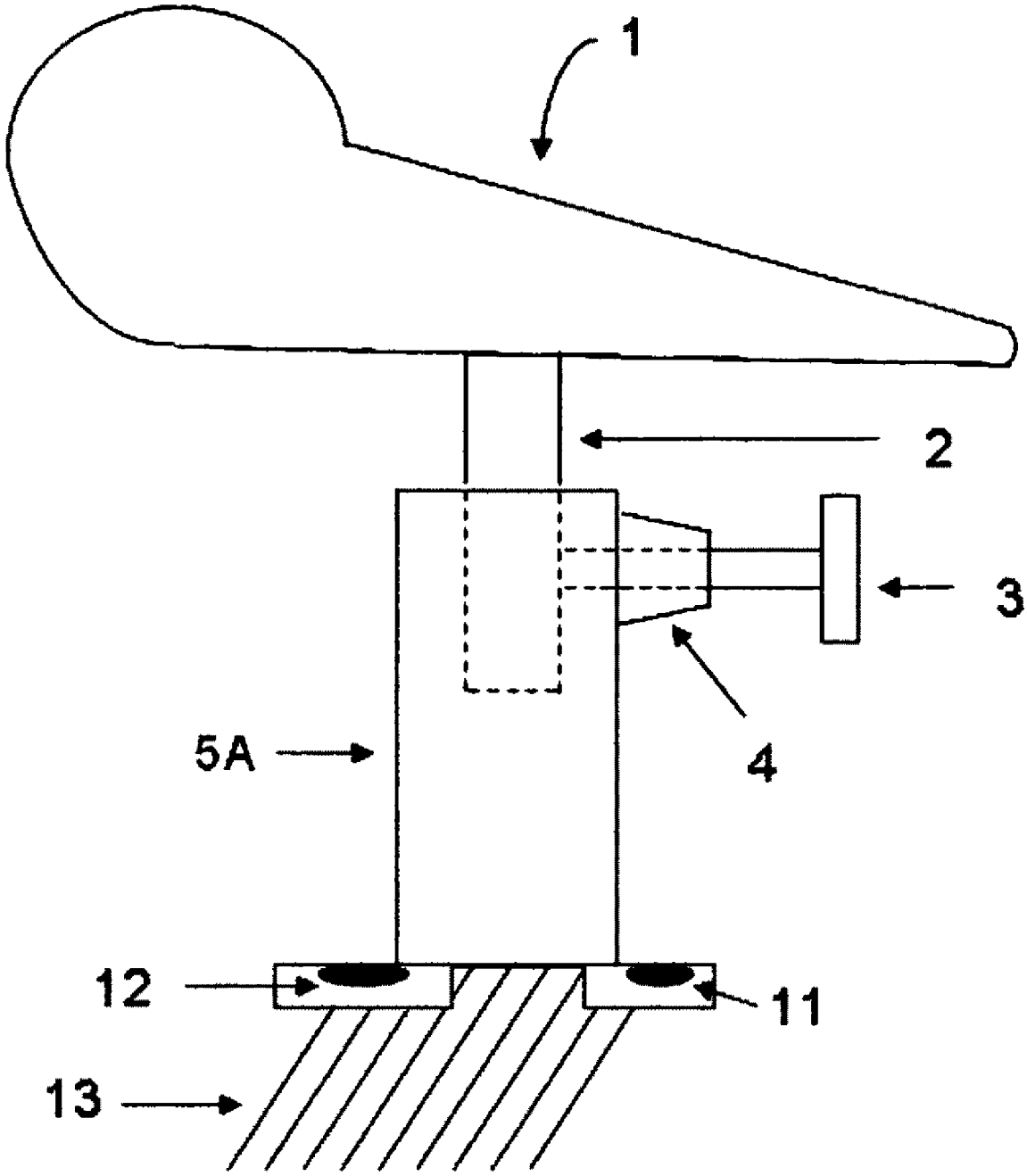
FIG. 3 is a plan view of a bassoon hand rest and post assembly as conventionally known.
Figure 4:
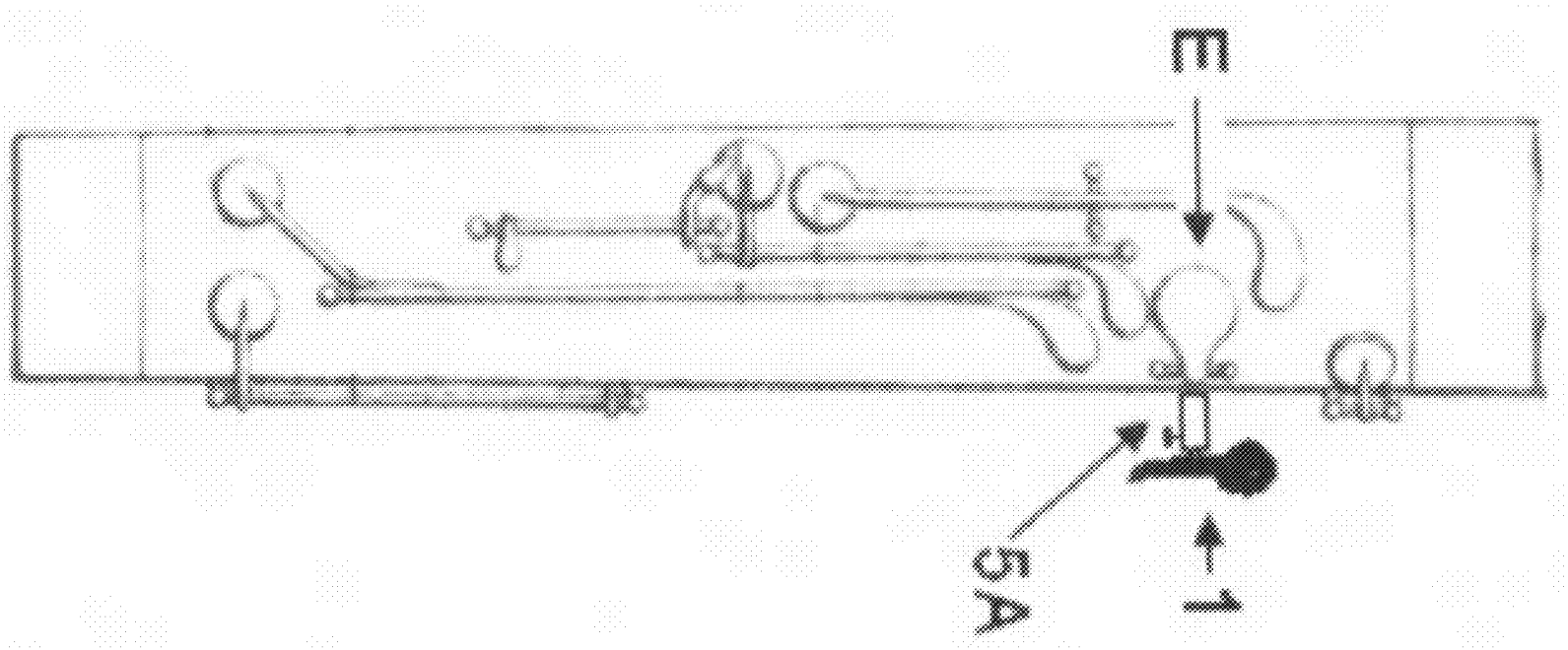
FIG. 4 is a back view of the boot joint of a bassoon with the bassoon hand rest and post assembly as conventionally known.

A single ball-and-socket joint can be utilized as an alternative to this design, that is, without the variable angle upper post pivoting about the screw 8. It would contain the conventional upper two holes for the bassoon hand rest (the upper part of FIG. 3)

Double Ball-and-Socket Hand Rest Post.

Figure 11:
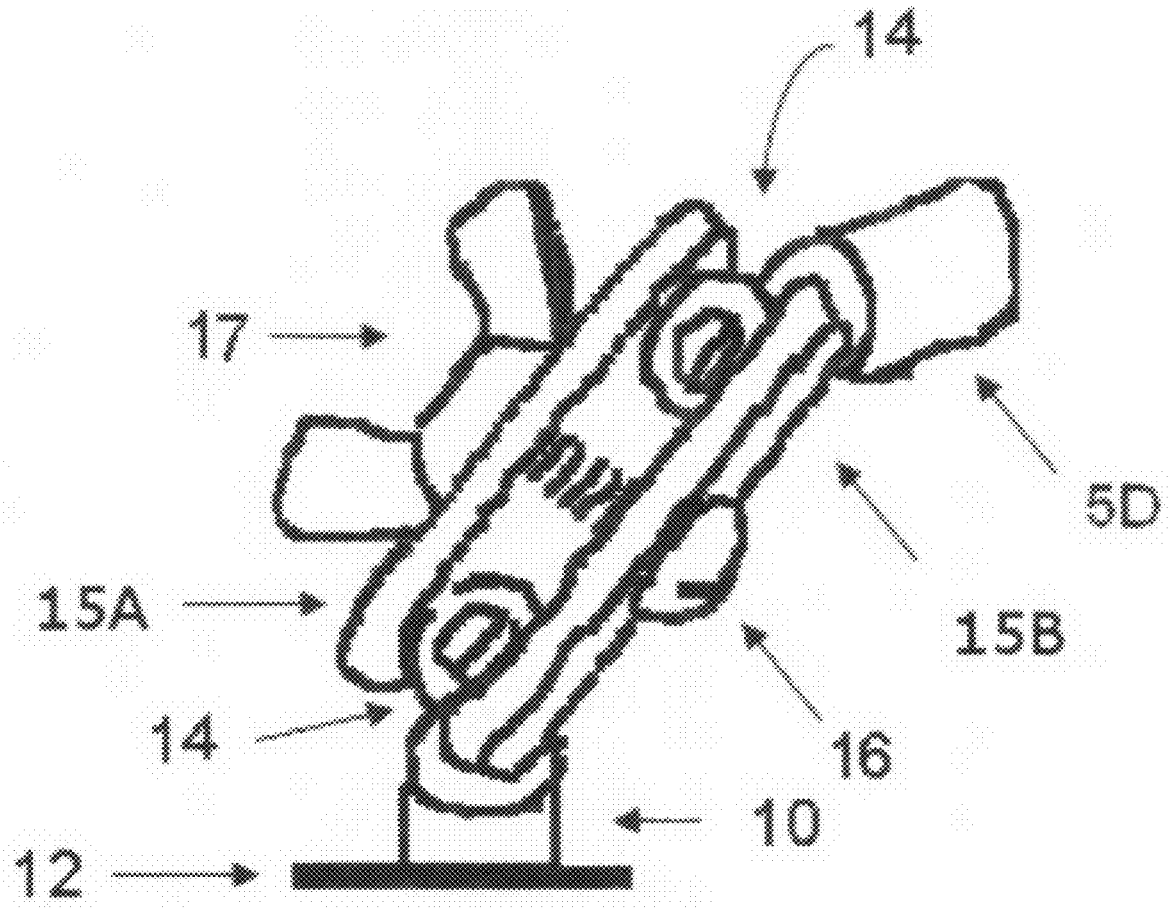
FIG. 11 is a plan view of the invention modified with a double ball-and-socket joint.

The modification of this invention utilizes two ball-and-socket joints which permit the adjustment of the hand rest along both the long (top-to-bottom) and short (side-to-side; lateral) dimensions of the bassoon as well as rotation of the entire mechanism. See FIG. 11. Illustrated is a conventional double-ball-and-socket joint which permits full three-dimensional mobility of the adjustable post unit about the anchor post. The hand rest post is comprised of two plates 15A and 15B, which house upper and lower balls 14 and is held together, for example, by a bolt and wing nut. The hand rest peg is inserted into 5D which is attached to the upper ball 14. The lower ball 14 is attached to the anchor post 10, which is then fixed to the base plate 12. Adjustment is performed by loosening the illustrated wing nut 17, which is wound on to the screw 16. Once the desired position of the hand rest is obtained the wing nut 17 is tightened. This is one example of a ball-and-socket joint permitting such mobility. The wing nut can be replaced by a thumbscrew or other fastening device. Aside from the ball-and-socket mechanism, the upper portion of the variable angle hand rest is as described above.

Fully Adjustable Flexible Steel or other Tubing Hand Rest Post

This invention (not shown) permits adjustment of the hand rest along both the long (top-to-bottom) or short (side-to-side; lateral) dimensions of the bassoon. A conventional, flexible steel tubing joint affixed to the curved base plate on one end and affixed to a hand rest post on the other end permits full three-dimensional mobility of the hand rest. Other types of flexible tubing material may be utilized as well. The hand rest may also be affixed permanently to the flexible tube, since the rotational degree of freedom imparted by the conventional pin of the hand rest is adequately represented by the range of motion of the flexible tube.

As these inventions may be embodied in several forms without departing from the spirit of the essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds, are therefore intended to be embraced by the claims.

The Bay Thumb Rest Functions Differently from a Bassoon Hand Rest

Figure 1:
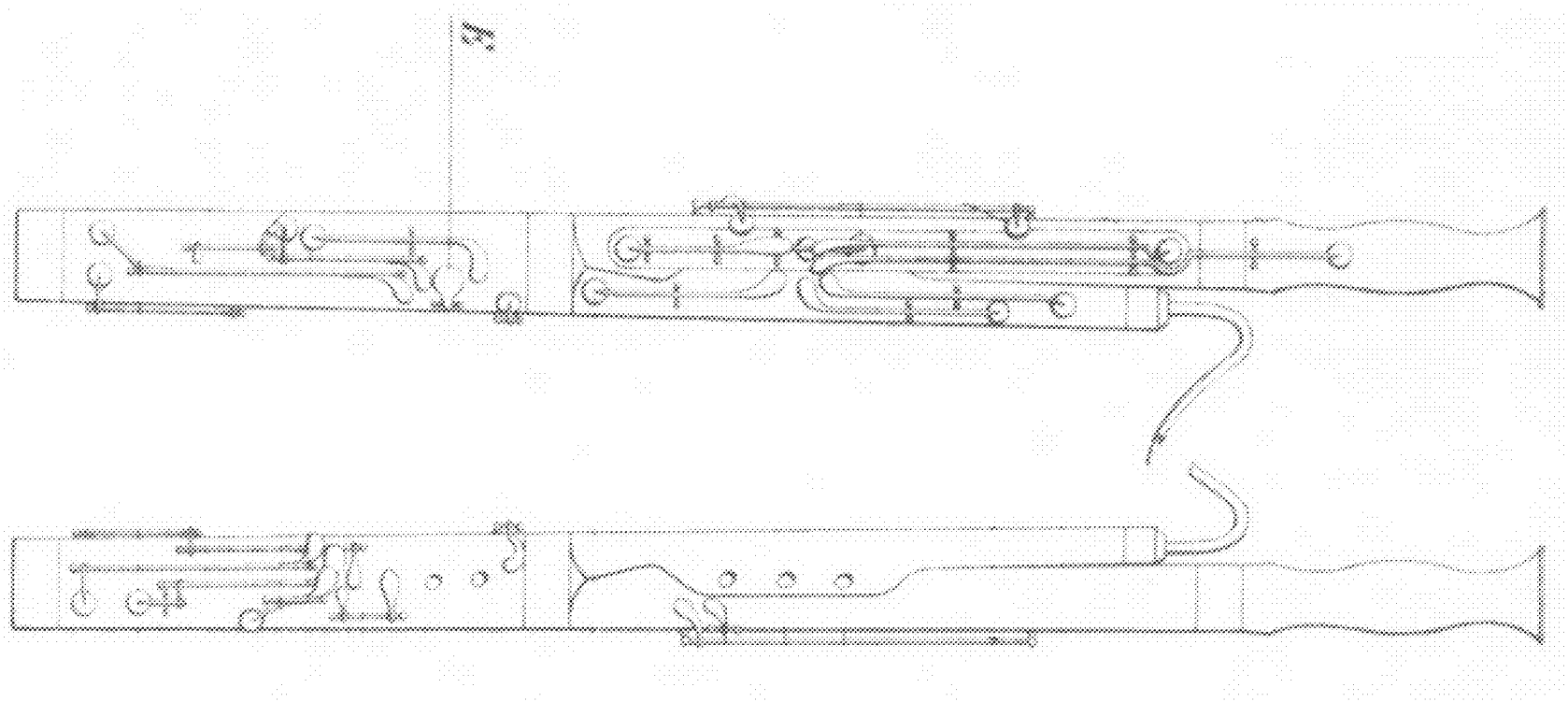
FIG. 1 is a back and front view of the bassoon as conventionally known.
Figure 2:
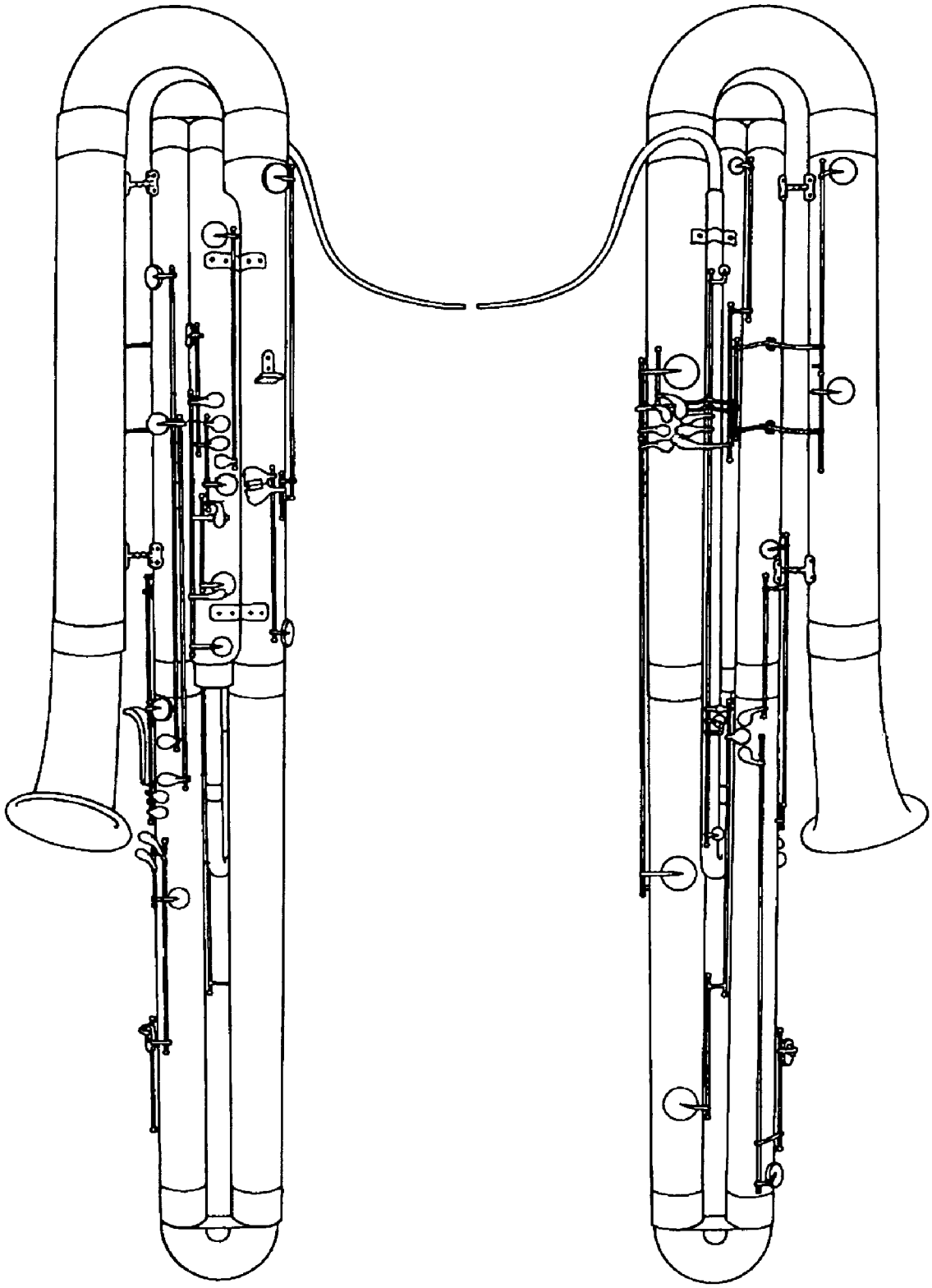
FIG. 2 is a back and front view of the contrabassoon as conventionally known.
Figure 12:
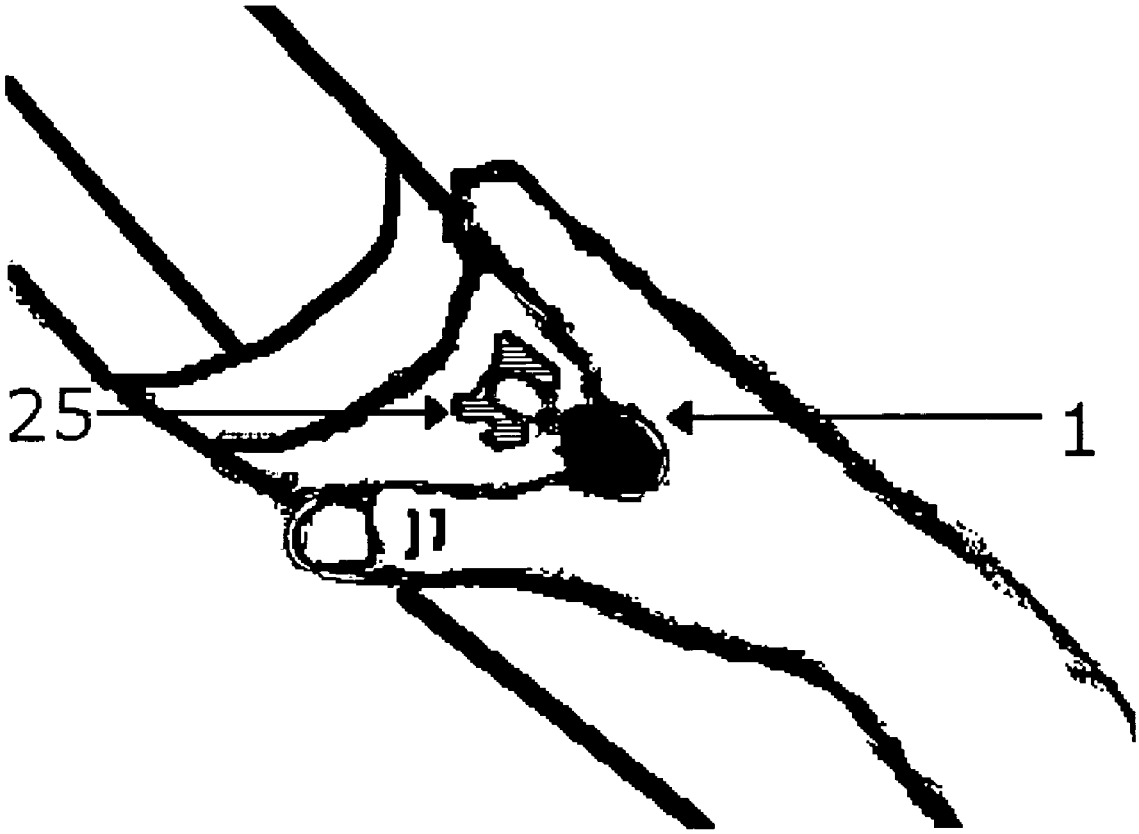
FIG. 12 is a view of the right hand placed on the hand rest which is inserted in the invention which is placed on the boot joint of the bassoon.

The ergonomics of an oboe and clarinet are similar in that both instruments rely on the right thumb for support. Thus the right thumb must remain stationary; it is not required to move in order to depress or release instrument keys covering tone holes or controlling tone hole covers; indeed there are no such keys under the control of the right thumb for the oboe or clarinet. In contrast, the opposite is true for the bassoon or contrabassoon. The right thumb on the bassoon and contrabassoon must remain fully mobile in order to press and release multiple instrument keys covering tone holes or controlling tone hole covers. Bay (U.S. Pat. No. 4,348,935) refers to a thumb rest, a device that rests the weight of the instrument on the thumb. This can be clearly seen in Bay, FIG. 1. Bay states, "The thumb of the lower hand does not operate any tone holes." In contrast, the claimed invention refers to a post with an attached hand rest. The post and hand rest are the device on which the player's right hand rests as seen in FIG. 12. The weight of the instrument is supported by the player's right hand in this position, and the right thumb remains fully mobile in order to depress or release instrument keys covering tone holes or controlling tone hole covers. As such, the modifications cited by Bay for the thumb rest on an oboe (or clarinet) do not apply to holding and positioning a bassoon. A bassoonist cannot utilize a thumb rest to support the instrument because the thumb must be free to press and release multiple instrument keys covering tone holes or controlling tone hole covers. In addition, the bassoon or contrabassoon is too heavy to be supported by the right thumb. These instruments always rely on other methods of support.

Degree of Angulation and Axes of Pivoting Post and Peg

The invention by Bay discloses a screw-like mechanism that adjusts the thumb rest with limited angulation along the long axis of the instrument. Bay states, "Another improvement has provided for limited axial and rotational adjustment of the conventional thumb rest." The amount of limited adjustment is not specified but is in the range of 20 degrees as inferred from the figures of Bay, said angle being highly limited by the proximity of the thumb-rest to the body of the oboe or clarinet, said proximity being required for the proper function of the thumb rest disclosed by Bay for the oboe or clarinet. In contrast, the claimed invention provides for wide angulation in either direction about the long axis of the instrument, over a range of at least 180 degrees. This degree of angulation is unique to this invention and is necessary in order to accommodate the different performance needs of an individual player and also the varied shapes and sizes of all performers' hands.

The post in Bay has a single rotational axis. Such is not the case with the claimed invention. The claimed invention allows for at least two rotational axes in the embodiments set forth above. First as noted above there is an adjustment angle of the adjustable post attached to the anchor post to range from 0 to at least 90 degrees from the perpendicular in either direction, that is, a full range of motion of at least 180 degrees, said adjustment angle being along a fixed axis of rotation parallel to the long axis of the bassoon or contrabassoon. Secondly, there is also the rotation of the hand rest peg 2 being inserted into the upper end of the variable hand rest post 5 that may rotate through a full angle of 360 degrees along an axis parallel to the long axis of said upper end of the variable hand rest post and perpendicular to the long axis of the bassoon or contrabassoon (see FIG. 5). One could not use the Bay thumb rest, even as possibly modified by Larsen (U.S. Pat. No. 4,285,263) to accommodate for these variances of rotation. Therefore, one of ordinary skill in the art could not combine Bay and Larsen to obtain these features, which are not part of either Bay or of Larsen, nor are appropriate or useful for the devices disclosed by Bay or Larsen.

The Bay Patent does not disclose each and every limitation. The independent claims of the claimed invention require the variable angle hand rest post to provide "a hole for affixing a hand rest peg." The Examiner relies on Bay to teach said hole, i.e., hole 34. The independent claims herewith provided require that this hole be functional for affixing a hand rest peg. The hole disclosed by Bay can only function to receive bolt 46. It is not shown or asserted how this hole could receive the claimed hand rest peg and still function, either as the thumb rest set forth by Bay or the claimed hand rest post. One of ordinary skill in the art would not devise a hand rest peg for insertion into the hole disclosed by Bay as the invention of Bay could not function as a thumb rest if such a hand rest peg were inserted into said hole.

Locking or Fixing Angulation and Axes of the Invention

Furthermore Bay does not disclose that the thumb plate is then set in a fixed position for playing. Although not stated, it is inferred from Bay that the "limited axial and rotational adjustment" remains active during the playing of the instrument. In contrast, the rotational movements of the claimed invention are locked once the musician is ready to perform. Such locking is performed along both of the two rotational axes. This unique feature is, in fact, necessary for the use of the claimed invention with the bassoon or contrabassoon. Not only does the claimed invention lock post 5 (FIG. 5) but it also secures hand rest peg 2. The Bay thumb rest, even as possibly modified by Larsen, could not accommodate this feature of locking the moving parts.

It is not clear from the rejection how Larsen clarifies the matter. The finger guard in Larsen features a long rod with ends that fit into posts. These posts feature no mechanism which allows for movement within the post or a method to lock in place moveable components. The invention by Larsen does not appear to feature any rotational axis at all, but rather is a stationary rod that is affixed on two ends by sliding the ends of the rods into the posts.

Conclusion: No Motivation to Combine Bay with Larsen

We again respectfully disagree with the statement "it would have been obvious to one of ordinary skill in the art at the time the invention was made to modify the rest post disclosed by Bay with an upper end of the adjustable post having a hole and a lower end affixing an anchor post as taught by Larsen." Larsen presents a fingering guide that does not support the clarinet. It is clear to a practicing musician that a thumb rest or other device must be used to support the instrument when performing. That being the case, it is clear that Larsen did not consider the fingering guide a modification of the traditional, prior art, thumb rest or seek in any way to combine the two inventions. The combination of the Bay and Larson inventions by one of ordinary skill in the art could not result in the claimed invention here due to the complexity and unique combination of features and requirement of the claimed invention.

The burden is on the Examiner to provide some suggestion of the desirability of doing what the inventor has done. "To support the conclusion that the claimed invention is directed to obvious subject matter, either the references must expressly or impliedly suggest the claimed invention or the examiner must present a convincing line of reasoning as to why the artisan would have found the claimed invention to have been obvious in light of the teachings of the references." Exparte Clapp, 227 USPQ 972,973 (Bd. Pat. App. & Inter. 1985).

Neither Bay nor Larson disclose the required elements of the claimed invention, specifically a bassoon or contrabassoon. Second, only those disclosures teaching a hand rest for a bassoon would instruct those of ordinary skill on the functioning of said hand rest. The mere fact that references be combined or modified does not render the resultant combination obvious unless the prior art also suggests the desirability of the combination. In re Mills, 9 16 F.2d 680,16 USPQ2d 1430 (Fed. Cir. 1990).

What is claimed is:

1. A variable angle hand rest post for a musical instrument comprising: an adjustable post unit with two ends, the two ends include, first, an upper end having a hole for affixing a hand rest peg; and a second, lower, end for affixing an anchor post; the anchor post is affixed to a curved plate; the function of said adjustable post requiring placement for proper balance at a location corresponding to that of the conventional non-variable hand rest post of a bassoon or contrabassoon, the hand rest post including a slot to be provided on the curved plate; said slot with the requirement to be positioned so as to provide room for the E key on the bassoon during placement on the musical instrument; said hand rest post allowing for realignment and angling when desired, with proper flexibility of function requiring the adjustment angle of the adjustable post attached to the anchor post to range from 0 to at least 90 degrees along a fixed axis of rotation parallel to the long axis of the bassoon or contrabassoon; after desired adjustment the variable hand rest post is secured to remain in a fixed position for musical practice or performance; said hand rest peg being inserted into the upper end of the variable hand rest post is rotatable through a full range of 360 degrees along an axis perpendicular to the long axis of the bassoon or contrabassoon; after desired adjustment and rotation of the hand rest peg within the upper end of the variable hand rest post, said hand rest peg is secured to remain in a fixed position for musical practice or performance; wherein the musical instrument is a bassoon or a contrabassoon.

2. The variable angle hand rest post of claim 1, wherein said attachment is used for the left or right hand.

3. The variable angle hand rest post of claim 1, wherein the hole for the hand rest peg measures up to ½ inch diameter.

4. The variable angle hand rest post of claim 1, wherein said anchor post, curved plate, and adjustable post unit are constructed from materials selected from the group consisting of wood, plastic, synthetic polymers, graphite, metal, or combinations thereof.

5. The variable angle hand rest post of claim 1, wherein the curved plate is attached to the musical instrument by means selected from the group consisting of an adhesive, screws, nails, clamp, or a combination thereof.

6. The variable angle hand rest post of claim 1, wherein the hand rest peg is secured into the hole of the adjustable post by means selected from the group consisting of a thumbscrew, wing nut, or screw.

7. The variable angle hand rest post of claim 1, wherein the adjustable post having a length and a slot extending from its second end to about halfway up its length, said slot receiving said anchor post.

8. A variable angle hand rest for a musical instrument comprising: a hand rest that includes a peg, an adjustable post unit with two ends; the two ends include, first, an upper end having a hole for affixing a hand rest peg; and a second, lower, end for affixing an anchor post; the anchor post is affixed to a curved plate; the function of said adjustable post requiring placement for proper balance at a location corresponding to that of a conventional non-variable hand rest post of the bassoon or contrabassoon, the hand rest post including a slot to be provided on the curved plate; said slot with the requirement to be positioned so as to provide room for the E key on the bassoon during placement on the musical instrument; said hand rest post allowing for realignment and angling when desired, with proper flexibility of function requiring the adjustment angle of the adjustable post attached to the anchor post to range from 0 to at least 90 degrees along a fixed axis of rotation parallel to the long axis of the bassoon or contrabassoon; after desired adjustment the variable hand rest post is secured to remain in a fixed position for musical practice or performance, said hand rest peg being inserted into the upper end of the variable hand rest post is rotatable through a full range of 360 degrees along an axis perpendicular to the long axis of the bassoon or contrabassoon; after desired adjustment and rotation of the hand rest peg within the upper end of the variable hand rest post, said hand rest peg is secured to remain in a fixed position for musical practice or performance; wherein the musical instrument is a bassoon or a contrabassoon.

9. The variable angle hand rest post of claim 8, wherein said attachment is used for the left or right hand.

10. The variable angle hand rest post of claim 8, wherein the hole for the hand rest peg measures up to ½ inch diameter.

11. The variable angle hand rest post of claim 8, wherein said anchor post, curved plate, and adjustable post unit are constructed from materials selected from the group consisting of wood, plastic, synthetic polymers, graphite, metal, or combinations thereof.

12. The variable angle hand rest post of claim 8, wherein the curved plate is attached to the musical instrument by means selected from the group consisting of an adhesive, screws, nails, clamp, or a combination thereof.

13. The variable angle hand rest post of claim 8, wherein the hand rest peg is located in the hole of the adjustable post at its first upper end and secured by the means selected from the group consisting of a thumbscrew, wing nut, or screw.

14. The variable angle hand rest post of claim 8, wherein the adjustable post having a length and a slot extending from its second end to about half way up its length, said slot receiving said anchor post.

15. A method of using the variable angle hand rest post of claim 1 or claim 8 comprising the steps of: inserting and securing the hand rest peg into the hole of the adjustable post at its first upper end, adjusting the adjustable post relative to the anchor post at an angle, with angulation about an axis parallel to the long axis of the bassoon or contrabassoon and incorporating a range of angulation of 0 to at least 90 degrees in either direction about said parallel axis, and securing the adjustable post in a position relative to the anchor post, with the curved plate affixed to the body of the instrument; said hand rest peg being inserted into the upper end of the variable hand rest post is rotatable through a full range of 360 degrees along the axis perpendicular to the long axis of the bassoon or contrabassoon; and after desired adjustment and rotation of the hand rest peg within the upper end of the variable hand rest post, said hand rest peg is secured to remain in a fixed position for musical practice or performance; wherein the musical instrument is a bassoon or a contrabassoon.

* * * * *